US008146929B1

(12) United States Patent
Johnson

(10) Patent No.: US 8,146,929 B1
(45) Date of Patent: Apr. 3, 2012

(54) SKATEBOARD WITH BEARINGS

(76) Inventor: Chrispen Johnson, Conroe, TX (US)

( * ) Notice: Subject to any disclaimer, the term of this patent is extended or adjusted under 35 U.S.C. 154(b) by 285 days.

(21) Appl. No.: 12/361,389

(22) Filed: Jan. 28, 2009

(51) Int. Cl.
*B62M 1/00* (2010.01)

(52) U.S. Cl. ..... 280/87.042

(58) Field of Classification Search ..... 280/87.042, 280/842, 843, 11.22, 11.226, 11.231, 11.27, 280/11.28, 87.041, 11.19, 11.23, 7.14, 11.25, 280/11.222, 11.233; 301/5.301
See application file for complete search history.

(56) References Cited

U.S. PATENT DOCUMENTS 3,310,320 A * 3/1967 Hanna et al. ..... 280/87.042
3,379,454 A 4/1968 Woodman
3,522,951 A 8/1970 Tyson
3,895,597 A 7/1975 Olevsky
4,149,735 A 4/1979 Blackburn et al.
4,181,316 A * 1/1980 Brand et al. ..... 280/11.207
4,618,158 A * 10/1986 Liberkowski ..... 280/843
5,152,691 A 10/1992 Moscarello
5,207,454 A 5/1993 Blankenburg et al.
5,409,265 A * 4/1995 Douglass ..... 280/843
5,553,874 A 9/1996 Schouten et al.
5,566,956 A 10/1996 Wang
6,293,565 B1 * 9/2001 Bouchard et al. ..... 280/11.226
6,401,900 B1 6/2002 Masciarelli, Jr.
6,419,249 B1 7/2002 Chen
6,435,558 B2 8/2002 Osawa
6,698,776 B2 3/2004 Todd

* cited by examiner

*Primary Examiner* — J. Allen Shriver, II
*Assistant Examiner* — James M Dolak
(74) *Attorney, Agent, or Firm* — Egbert Law Offices PLLC

(57) ABSTRACT

A skateboard has a body that has a first end and a second end, a first mounting plate positioned adjacent the first end of the body with recesses formed therein, a second mounting plate positioned adjacent the second end of the body with recesses formed therein, a housing positioned within each of the recesses of the first and second mounting plates, and a ball-and-socket assembly resiliently positioned within an interior of each housing. A brake extends angularly downwardly from the first end of the body.

10 Claims, 3 Drawing Sheets

SKATEBOARD WITH BEARINGS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to skateboards. More particularly, the present invention the relates to skateboards that have bearings for rolling along skateboarding surfaces.

2. Description of Related Art Including Information Disclosed Under 37 CFR 1.97 and 37 CFR 1.98

A skateboard is the primary piece of equipment used in the activity of skateboarding. The exact origins of the first skateboard are unknown, but it is known that skateboarding started in the 1950s. The first skateboards were made by attaching roller-skate wheels to the bottom of wooden boxes or boards. Over the years, the structure of a skateboard and the activity of skateboarding evolved into precisely engineered equipment used by professional skateboarders.

A typical modern skateboard has a deck, two metal trucks secured to the bottom of the deck, and wheels placed on the axles of the trucks. Each skateboard wheel is typically mounted to the axles of the trucks with ball bearings. Various accessories can be included with the modern skateboard, including rails, slip tape, laquer, a nose guard, a tail guard, and angled risers. Modern skateboards can be personalized according to the needs of an individual skateboarder.

Skate parks are now common in many cities. Skateboarding competitions have lead to a dramatic increase of talent and athleticism associated with the skateboarding activity. Professional skateboarders, such as Tony Hawk, enjoy much frame and notoriety for their skateboarding abilities. Skateboarding professionals can also have large incomes due to lucrative deals for winning competitions, obtaining brand sponsorships, and advertising. Various televisions networks regularly televise skateboarding competitions.

Although skateboarding is now a mainstream activity, the technology associated with skateboard components continuously evolves. In particular, skateboarders seek to out-maneuver one another for earning points in competitions. Non-competitive skaters, and the skateboard community as a whole, seek to find new tricks for the skateboard. Thus, there is a need for a skateboard that increases a skateboarder's ability to maneuver on a skateboard so as to invent and perform new tricks for the skateboard community.

A problem associated with typical skateboards is that the skateboards travel in only one direction. That is, there is no lateral movement with the typical skateboard because the wheels of the skateboard are all aligned in the same direction and all rotate in the same direction. Thus, there is a need for a skateboard that allows for a skateboarder to move in any direction.

Another problem associated with typical skateboards is that the surface of contact with the wheels of the skateboard causes friction with the skateboarding surface. As a result, skateboards have limited speed over skateboarding surfaces. Various improvements in the bearings associated with the wheels and other such technologies attempt to reduce the friction associated with movement of the skateboard; however, there is a need for a skateboard that can reduce contact with a skateboarding surface so as to reduce the friction between the skateboard and the skateboarding surface so as to increase the velocity of the skateboard.

Various patents have issued relating to skateboards with bearings. For example, U.S. Pat. No. 5,409,265, issued on Apr. 25, 1995 to Douglass, discloses a skateboard that has ball rollers rotatably mounted within cavities formed in a bottom of a body of the skateboard. Ball bearings are mounted within the cavity so as to contact the roller ball and rotate as the roller ball rotates. Round islands, or mounts, are located adjacent to each roller ball. The round islands receive a side guide or a side plug that controls the pitching and steering of the body of the skateboard. A glide plate is provided over the cavities at the bottom of the body for providing a sliding surface. Air passages are formed in the body and extend from the front end and from the back end toward the middle of the skateboard. The air passages are communicative with the cavities so as to allow air to cool the ball bearings located within the cavities. Circular cover plates are connected to the body over the glide plate, the mounts, and the roller ball. Each roller ball partially extends through the cover plate so that the side guide and the side plug protrude therein. A conical cleaner is provided adjacent each roller ball for contacting the roller ball in order to clean debris from the roller ball.

U.S. Pat. No. 3,310,320, issued on Mar. 21, 1967 to Hanna, discloses a skateboard that has a platform member, outer casters attached to the underside of the platform member, and a center caster attached to the underside of the platform member. The outer casters are disposed at the apexes of an equilateral triangle configuration of the underside of the platform member. The center caster is located centrally of the triangular arrangement of the outer casters. The center caster extends a distance from the platform member greater than a distance of the outer casters from the platform member.

U.S. Pat. No. 3,522,951, issued on Aug. 4, 1970 to Tyson, discloses a roller ski for use on a reasonably smooth slope in the absence of snow that has a ski member with an upper surface, a lower sliding surface, an inner edge, and an outer edge. The upper surface has bindings for attachment to a foot. Ball-type rollers are rotatably affixed to the outer portion of the roller surface. Skate wheels are affixed to the lower surface of the ski member adjacent the inner edge thereof. The skate wheels are disposed in longitudinal alignment. The axis of rotation of the skate wheels is perpendicular to a longitudinal axis of the ski member.

U.S. Pat. No. 4,149,735, issued on Apr. 17, 1979 to Blackburn et al., discloses a skateboard pivot-roller assembly that has amounting bracket formed with a generally flat upwardly facing mounting surface for mating with the flat underside of the skateboard platform. The skateboard pivot roller assembly is formed in one extremity with a roller housing. The housing has a downwardly opening ball socket having a rotatable ball mounted therein and projecting downwardly therefrom so that a lower spherical surface is spaced above the plane of the bottom of the skateboard wheels. A skateboard rider can shift a weight to the end of the skateboard so as to tilt the skateboard and engage the pivot ball with the ground. Engaging the pivot ball with the ground enables pivoting and maneuvering of the rider with at least a portion of the weight carried on the ball.

U.S. Pat. No. 5,207,454, issued on May 4, 1993 to Blankenburg et al., discloses an in-line roller skate that has a frame with a pair of parallel, spaced side rails. Ball rollers are mounted in the frame between the forward and rearward ends of the frame. Each ball roller is mounted to the frame for unidirectional movement by a base attached to the frame. A concave bed is formed in the base and is substantially covered by rotatable bearings. A cap with a central aperture in an end wall is secured to the base and encloses the bearings and the ball roller. A portion of the ball roller extends through the central aperture in the cap.

U.S. Pat. No. 3,379,454, issued on Apr. 23, 1968 to Woodman, discloses a device that has a support, a ball, and a mechanism holding the ball in the support. A ball-forming mechanism guides the support during motion thereof relative to the supporting surface in any direction. The ball-forming mechanism provides for instantaneous changes of direction of the ball. The mechanism for holding the ball provides for free-rolling action of the ball in any direction relative to the support. Bearings are located in the ball-holding mechanism. The ball-holding mechanism forms an enclosure for a portion of the ball. The bearing has an annular member extending adjacent the ball. A brake is attached to the support and adapted so as to engage the ball within the annular member.

U.S. Pat. No. 3,895,597, issued on Jul. 22, 1975 to Olvesky, discloses a wind operated amphibious vehicle that has a frame, a sail, and three wheels that are buoyant enough to support the vehicle in water. Brake and steering devices act on the two back wheels. The frame has cavities formed therein. The cavities receive the ball wheels. Each of the cavities has ball bearings between the cavity and the ball wheels.

U.S. Pat. No. 5,152,691, issued on Oct. 6, 1992 to Moscarello, discloses an apparatus designed to allow the user to simulate the action of a snowboard during dryland training. The apparatus has a cylindrical roller that has tapered or angled surface at the outer portions of the roller. The tapered sections may have slots cut into them which would allow for a stepping effect from one tapered surface to the other. Spacers are attached to the lower surface of the receiving board. The spacers provide stability to the apparatus. The receiving board attaches to the lower surface of the upper deck by using vertical lifts.

U.S. Pat. No. 5,553,874, issued on Sep. 10, 1996 to Shouten et al., discloses a roller board apparatus that has an elongated user support platform, and front and rear axles mounted transversely across one side of the platform adjacent the front and rear ends of the platform. The curve axles curve symmetrically outwardly away from the platform surface to which they are attached. The curve axles include wheels rotatably mounted therealong. Spacers are positioned between each end of the curve axles in the platform.

U.S. Pat. No. 5,566,956, issued on Oct. 22, 1996 to Wang, discloses an in-line skateboard that has a toe-abutment wall for preventing forward movement of the rider's shoes, and a heel support that supports the shoe heels at an elevation substantially above the surface of the board. In-line wheels can be replaced with a single skate blade for using the skateboard on ice.

U.S. Pat. No. 6,401,900, issued on Jun. 11, 2002 to Masciarelli, Jr., discloses a unidirectional rotating support assembly that has a support member, a rotating member, and a support mechanism that rotatably supports the unidirectional rotating member with respect to the support member. The support member is configured or arranged so that a portion thereof is received in the aperture in such a fashion that the support member has limited ability to move with respect to the work station surface.

U.S. Pat. No. 6,419,249, issued on Jul. 16, 2002 to Chen, discloses a roller board that has a base plate with a cam-retaining bore and an accommodating chamber. A roller unit has a caster mounted rotatably to the base plate underneath the retaining bore. A roller is journalled to the caster. A cam extends into the chamber via the retaining bore in the base plate. The cam has diametrically opposite lowermost points and diametrically opposite uppermost points between the lowermost points. A cam follower is disposed within the chamber. The cam follower includes an urging spring that has a first end fixed to the base plate and a second end disposed above, and abutting against, the cam face so as to urge the cam in an axial direction relative to the cam.

U.S. Pat. No. 6,435,558, issued on Aug. 20, 2002 to Osawa, discloses a roller ski board that has a board body that bends elasticity, a single roller at its central portion. Smaller twin rollers are positioned at the front and rear edge portions. The rollers are pivoted rotatively on an under surface of the board body along its longitudinal axis. The rollers are lubricated and wear-resistant. The roller has an elasticity that allows them to absorb the vibrations and shock added to the board from contacting a surface, such as the ground. The rollers are arranged such that the external side periphery of each of the rollers is gradually wider from the central portion to the front and rear edges so that the periphery of each roller do not protrude over the contour curvature of the board body.

U.S. Pat. No. 6,698,776, issued on Mar. 2, 2004 to Todd, discloses a skateboard that has a support platform, and wheels mounted to the support platform. The wheels have successively decreasing diameters. The wheels are mounted on a common axle. The wheels are formed of a material of successively greater frictional and compressibility characteristics.

It is an object of the present invention to provide a skateboard that is omnidirectional.

It is another object of the present invention to provide a skateboard that reduces the area of contact between the skateboard and the skateboarding surface.

It is another object of the present invention to reduce friction between the skateboard and the skateboarding surface.

It is another object of the present invention to provide better stability than other skateboards that utilize ball bearings.

It is still another object of the present invention to provide a skateboard that can support large weights.

It is another object of the present invention to provide a skateboard that has a brake that allows the rider to slow or stop the skateboard.

It is another object of the present invention to provide a skateboard that increases maneuverability.

These and other objects and advantages of the present invention will become apparent from a reading of the attached specification and appended claims.

BRIEF SUMMARY OF THE INVENTION

The present invention is a skateboard comprising a body having a first end and a second end, a first mounting plate positioned adjacent the first end of the body that has a three recesses formed therein, a second mounting plate positioned adjacent the second end of the body that has three recesses formed therein, and a ball-and-socket assembly positioned within each of said plurality of recesses of said first and second mounting plates. The housing has a lip on an end thereof. A brake extends angularly downwardly from the first end of the body. A housing is positioned within each of the recesses of the first and second mounting plates. The ball-and-socket assembly is resiliently positioned in the housing.

Each of the plurality of recesses comprises a first recess positioned on the mounting plate, a second recess spaced from the first recess, and a third recess spaced from the first recess. The first, second, and third recesses are arranged in a triangular pattern.

The ball-and-socket assembly comprises a socket positioned within the housing, a spring having an end adjacent a top of the housing and an opposite end adjacent the socket, and a ball positioned within the socket. The socket comprises a receiver member that receives the ball in an interior thereof, a cover plate positioned adjacent the receiver member, a sweeper positioned between the cover plate and the ball, and a plurality of bearings positioned between the ball and the receiver member. The cover plate has a diameter larger than a diameter of the ball.

The receiver member has a domed portion and a flat outer portion. The flat outer portion extends radially outwardly from the domed portion. The housing has a narrow portion adjacent a wide portion. The cover plate has a lip extending around the flat outer portion of the receiver member. The flat outer portion of the receiver member and the lip of the cover plate are positioned in the wide portion of the housing. The sweeper has a tapered portion that is suitable for contacting an outer surface of the ball. The lip of the housing is adjacent an end of the wide portion opposite the narrow portion. The lip of the housing extends radially inwardly from the end of the wide portion. The lip of the housing has an inner diameter smaller than an outer diameter of the socket.

DETAILED DESCRIPTION OF THE INVENTION

Figure 1:
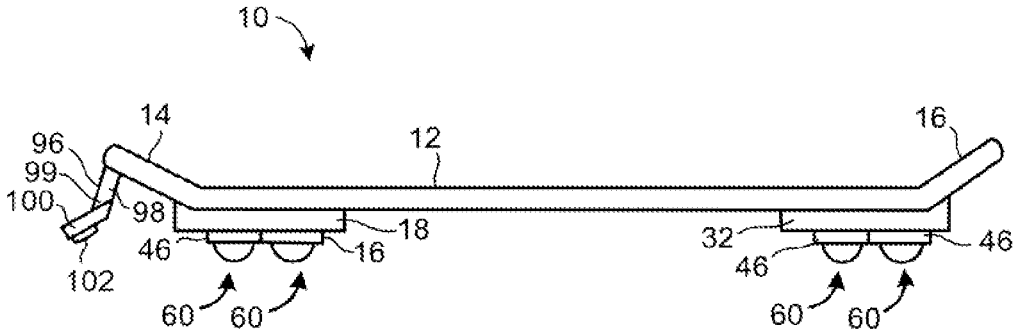
FIG. 1 shows a side elevational view of the preferred embodiment of the skateboard of the present invention.

Referring to FIG. 1, there is shown a side elevational view of the preferred embodiment of the skateboard 10 of the present invention. The skateboard 10 has a body 12. The body 12 has a first end 14 and a second end 16. A first mounting plate 18 is positioned adjacent the first end 14 of the body 12. First mounting plate 18 has recesses formed therein, which receive housings 46. Ball-and-socket assemblies 60 are resiliently positioned within the interior of the housings 46. A second mounting plate 32 is positioned adjacent the second end 16 of the body 12. The second mounting plate 32 has recesses formed therein that receive housings 46. Ball-and-socket assemblies 60 are resiliently positioned within the interiors of the housings 46. A brake 96 is attached to the first end 14 of the body 12. The brake 96 has a first portion 98 and a second portion 100. The first portion 98 is attached to the first end 14 of the body 12. The second portion 100 is attached to an end 99 of the first portion 98 opposite the body 12. The first portion 98 extends angularly downwardly from the first end 14 of the body 12. The second portion 100 extends angularly downwardly from an end 99 of the first portion 98 opposite the body 12. The second portion 100 has a brake surface 102 thereon. A user of the skateboard 10 can apply pressure to the first end 14 of the body 12 so as to pivot the first end 14 downwardly and the second end 16 upwardly so that the braking surface 102 contacts a skateboarding surface. The braking surface 102 is of a material typically used for stopping skates, inline skates, and skateboards.

Figure 2:
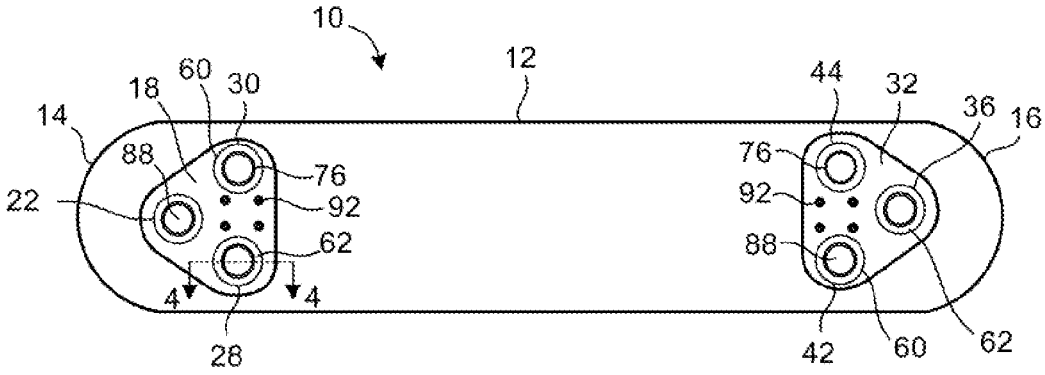
FIG. 2 shows a bottom view of the preferred embodiment of the skateboard of the present invention.

Referring to FIG. 2, there is shown a bottom view of the preferred embodiment of the skateboard 10 of the present invention. The first mounting plate 18 can be seen adjacent the first end 14 of the body 12. The second mounting plate 32 can be seen adjacent the second end 16 of the body 12. The mounting plates 18 and 32 are affixed to the body 12 by bolts 92. The first mounting plate 18 has a first recess 22, a second recess 28, and a third recess 30. The second mounting plate 32 has a first recess 36, a second recess 42, and a third recess 44. The recesses 22, 28, and 30 of the first mounting plate 18 are in a generally triangular orientation. The recesses 36, 42, and 44 of the second mounting plate 32 are in a generally triangular orientation. A housing 60 is placed in each of the recesses 22, 28, 30, 36, 42, and 44. A ball-and-socket assembly 60 is placed in each housing 46. The sweepers 76 can be seen in the ball-and-socket assemblies 60. The balls 88 are positioned in the ball-and-socket assembly 60. In the preferred embodiment of the skateboard 10 of the present invention, the mounting plates 18 and 32 are spaced apart so that when a user stands on a skateboard 10 the weight is distributed toward the ends 14 and 16 of the body 12. Three ball-and-socket assemblies 60 are preferably included on each end 14 and 16 of the body 12 of the skateboard 10. Thus, the skateboard 10 of the present invention has six points of contact with the skateboarding surface. These points of contact increase stability over prior art that has fewer points of contact.

Figure 3:
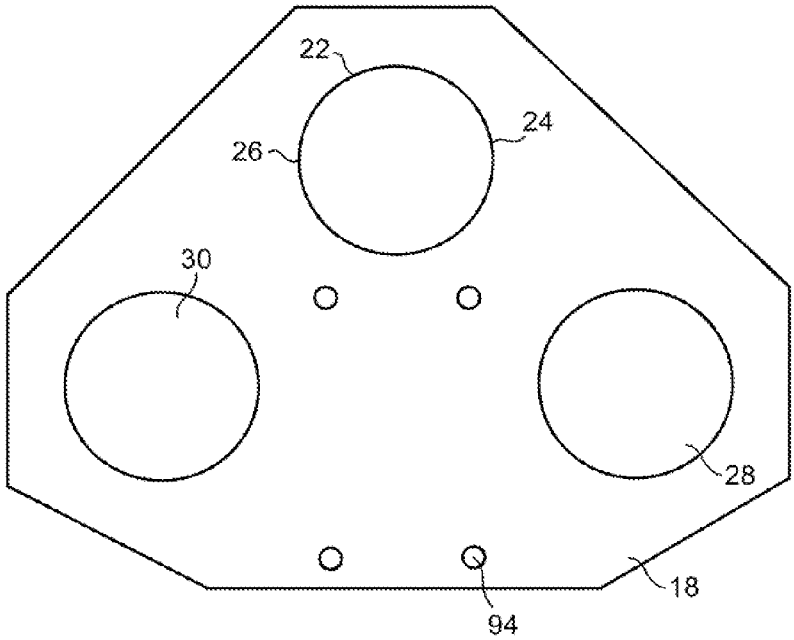
FIG. 3 shows an isolated plan view of the mounting plate of the present invention.

Referring to FIG. 3, there is shown an isolated plan view of the first mounting plate 18 of the present invention. The first mounting plate 18 has a first recess 22 positioned horizontal centrally on the mounting plate 18. A second recess 28 is spaced from a side 24 of the first recess 22. A third recess 30 is spaced from an opposite side 26 of the first recess 22. The second recess 28 and the third recess 30 are equidistant from the first recess 22. The first recess 22, second recess 28, and third recess 30 are preferably in a triangular orientation. Holes 94 are formed in the mounting plate 18 so that the mounting plate 18 can be attached with bolts to the body 12 of the skateboard 10. The holes 94 can be optimally located so as to provide sufficient contact between the mounting plate 18 and the body 12 of the skateboard 10. The recesses 22, 28 and 30 are cylindrical in shape. The recesses 22, 28, and 30 preferably have a depth that is less than the depth of the mounting plate 18. The mounting plate 18 is polygonal in shape; however, the mounting plate 18 can be formed of any shape that can encompass the triangular orientation of the recesses 22, 28, and 30. In other models, the mounting plate 18 has more curved sides than the abruptly angling sides of the mounting plate 18 shown in FIG. 3. The shape of the recesses 22, 28, and 30 can be of other shapes that suitably receive the housings 46.

Figure 4:
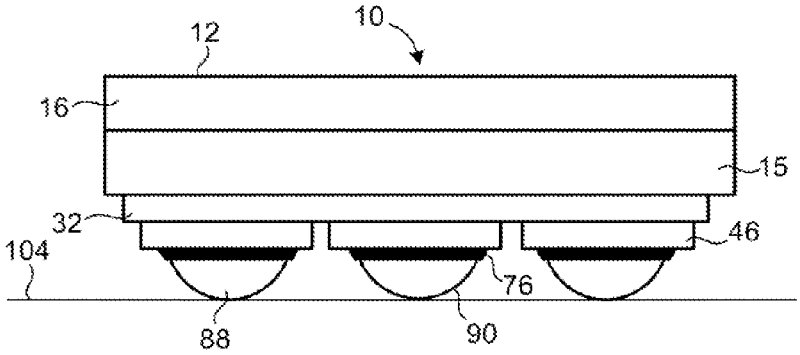
FIG. 4 shows an end elevational view of the preferred embodiment of the skateboard of the present invention.

Referring to FIG. 4, there is shown an end elevational view of the skateboard 10 of the present invention. The second end 16 of the body 12 angles downwardly toward the middle 15 of the body 12. The second mounting plate 32 is attached to a bottom of the body 12. The housings 46 can be seen as extending outwardly from the recesses of the mounting plate 32. The sweepers 76 can be seen as extending out of the housings 46 and contacting the outer surface 90 of the balls 88. Only a small point 88 of each of the balls touches the skateboarding surface. Thus, the skateboard 10 of the present invention reduces the surface of contact between the skateboard 10 and the skateboarding surface 104. As a result, the friction between the balls 88 and the skateboarding surface 104 is less than the friction between the wheels and the skateboarding surface 104 of a traditional skateboard. With less surface contact and reduced friction, the skateboard 10 of the present invention can change direction much quicker and move at a higher velocity than traditional skateboards. The balls 88 can move at any direction. Therefore, the skateboard 10 of the present invention is highly maneuverable and can allow a rider to skate in any direction regardless of the orientation of the body 12 of the skateboard 10.

Figure 5:
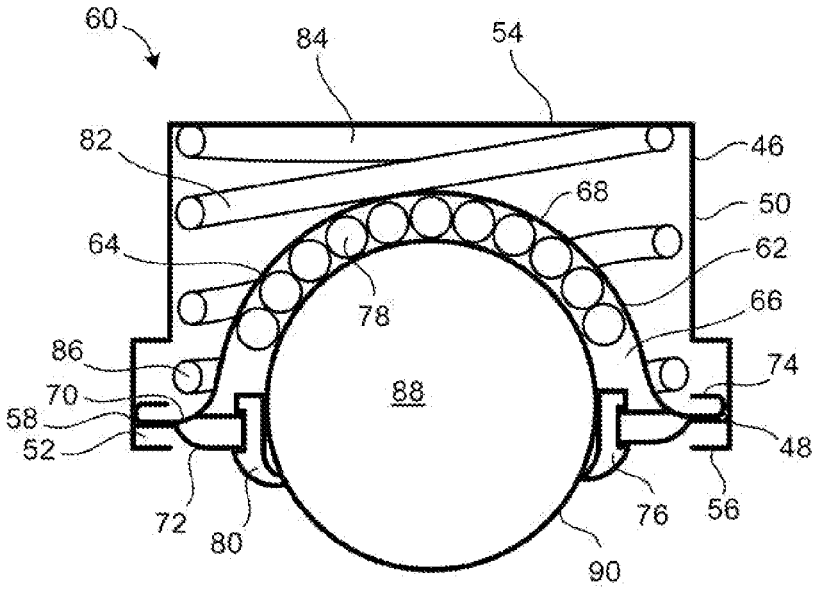
FIG. 5 shows a cross-sectional view of the ball-and-socket assembly of the present invention, taken along sight line 4-4 in FIG. 2.

Referring to FIG. 5, there is shown a cross-sectional view of the ball-and-socket assembly 60 of the present invention, taken along sight line 4-4 in FIG. 2. The ball-and-socket assembly 60 has a socket 62 positioned within the housing 46. A spring 82 is positioned within the interior of the housing 46. The spring 82 has an end 84 adjacent a top 54 of the housing 46 and an opposite end 86 adjacent the socket 62. The ball 88 is positioned within the socket 62. The socket 62 has a receiver member 64 receiving the ball 88 in an interior thereof, a cover plate 72 positioned adjacent the receiver member 64, a sweeper 76 positioned between the cover plate 72 and the ball 88, and bearings 78 positioned between the ball 88 and the receiver member 64. The cover plate 72 has a diameter that is larger than a diameter of the ball 88. The receiver member 64 has a domed portion 68 and a flat outer portion 70. The flat outer portion 70 extends radially outwardly from the domed portion 68. The housing 46 has a narrow portion 50 and a wide portion 48. The cover plate 72 has a lip 74 that extends around the flat outer portion 70 of the receiver member 64. The flat outer portion 70 of the receiver member 64 and the lip 74 of the cover plate are positioned in the wide portion 48 of the housing 46. The sweeper 76 has a tapered portion 80. The tapered portion 80 is suitable for contacting an outer surface 90 of the ball 88. The housing 46 has a lip 56 on an end 58 thereof. The lip 56 of the housing 46 is adjacent an end 52 of the wide portion 48 opposite the narrow portion 50. The lip 56 of the housing 46 extends radially inwardly from the end 52 of the wide portion 48. The lip 56 of the housing 46 has an inner diameter that is smaller than an outer diameter of the socket 62. The narrow portion 50 of the housing 46 is positioned in the recesses 22, 28, 30, 36, 42 and 44 of the mounting plates 18 and 32.

The ball-and-socket assembly 60 is resiliently positioned within an interior of the housing 46. The lip 74 of the cover plate 72 extends over the flat outer portion 70 of the receiver member 64 so as to keep the cover plate 72 and receiver member 64 adjacent one another. Bearings 78 are placed within the interior 66 of the receiver member 64 between the domed portion 68 of the receiver member 64 and the outer surface 90 of the ball 88. The bearings 78 rotate when the ball 88 rotates. The bearings 78 are typical bearings that are used in mechanical devices. The ball 88 is preferably a large bearing that is made of metal and resistant to scratching and denting. As the ball 88 rolls and rotates within the interior 66 of the receiver member 64, the tapered portion 80 of the sweepers 76 sweeps dirt away from the surface 90 of the ball 88. The spring 82 is in compression between the top 54 of the housing 46 and the socket 62. The spring 82 urges the socket 62 towards the end 52 of the wide portion 48 opposite the narrow portion 50. Thus, the spring 82 urges the cover plate 72 adjacent the lip 56 of the housing 46. Forces exerted upwardly on the ball 88 by a skateboarding surface cause the ball 88 to push upwards against the bearings 78, which push upwards toward the domed portion 68 of the receiver member 64 of the socket 62. Thus, the socket 62 can move within the interior of the housing 46. Thus, the ball-and-socket assembly 60 of the skateboard 10 of the present invention has a suspension for dampening the upward forces caused by contact between the ball 88 and the skateboarding surface. Thus, the ball-and-socket assembly 60 provides for a smoother and more comfortable ride on the skateboard 10 of the present invention.

Figure 6:
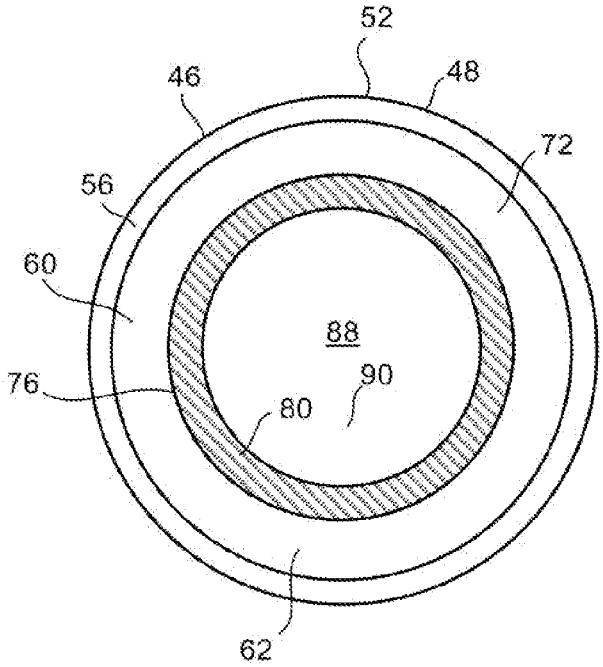
FIG. 6 shows a plan view of the ball-and-socket assembly of the present invention.

Referring to FIG. 6, there is shown a plan view of the ball-and-socket assembly 60 of the skateboard 10 of the present invention. The lip 56 of the housing 46 extends radially inwardly from the end 52 of the wide portion 48 of the housing 46. The lip contacts the cover plate 72 of the socket 62. The sweeper 76 is positioned between the cover plate 72 and the ball 88. The tapered portion 80 of the sweeper 76 contacts the outer surface 90 of the ball 88. The lip 56 of the housing 46 is concentric with the housing 46. The cover plate 72 of the socket 62 is concentric with the lip 56. The sweeper 76 is concentric with the cover plate 72. The ball 88 is concentric with the sweeper 76.

The foregoing disclosure and description of the invention is illustrative and explanatory thereof. Various changes in the details of the illustrated construction of the present invention can be made within the scope of the appended claims without departing from the true spirit of the invention. The present invention should only be limited by the following claims and their legal equivalents.

I claim:

1. A skateboard comprising:

a body having a first end and a second end;

a first mounting plate positioned adjacent said first end of said body, said first mounting plate having a first recess and a second recess and a third recess in spaced relation to each other and arranged in an equilateral triangular pattern;

a second mounting plate positioned adjacent said second end of said body, said second mounting plate having a first recess and a second recess and a third recess in spaced relation to each other and arranged in an equilateral triangular pattern; and a plurality of ball-and-socket assemblies respectively received in said recesses of said first and second mounting plates, said plurality of ball-and-socket assemblies respectively having balls extending downward therefrom such that the balls having a coplanar bottom surface and are of a similar diameter.

2. The skateboard of claim 1, further comprising:

a brake member extending angularly downwardly from said first end of said body.

3. The skateboard of claim 1, further comprising:

a housing positioned within each of the recesses of said first and second mounting plates, the ball-and-socket assembly resiliently positioned in the housing.

4. The skateboard of claim 3, the ball-and-socket assembly comprising:

a socket positioned within said housing; and a spring having an end adjacent a top of said housing, said spring having an opposite end adjacent said socket, the ball being positioned within said socket.

5. The skateboard of claim 4, said socket comprising:

a receiver member receiving the ball in an interior thereof;

a cover plate positioned adjacent said receiver member, said cover plate having a diameter larger than a diameter of the ball;

a sweeper positioned between said cover plate and the ball; and a plurality of bearings positioned between the ball and said receiver member.

6. The skateboard of claim 5, said receiver member having a domed portion and a flat outer portion, said flat outer portion extending radially outwardly from said domed portion.

7. The skateboard of claim 6, said housing having a narrow portion adjacent a wide portion, said cover plate having a lip extending around said flat outer portion of said receiver member, said flat outer portion of said receiver member and said lip of said cover plate being positioned in said wide portion of said housing.

8. The skateboard of claim 5, said sweeper having a tapered portion, said tapered portion suitable for contacting an outer surface of said ball.

9. The skateboard of claim 3, said housing having a narrow portion adjacent a wide portion, said housing having a lip adjacent an end of said wide portion opposite said narrow portion.

10. The skateboard of claim 9, said lip of said housing extending radially inwardly from said end of said wide portion, said lip of said housing having an inner diameter smaller than an outer diameter of said socket.

* * * * *